US008659382B2

(12) United States Patent
Xu et al.

(10) Patent No.: US 8,659,382 B2
(45) Date of Patent: Feb. 25, 2014

(54) NON-ENCAPSULATED-WINDING STEREO WOUND-CORE DRY-TYPE AMORPHOUS ALLOY TRANSFORMER

(75) Inventors: Kaixuan Xu, Kaiping (CN); Xianqing Guo, Kaiping (CN)

(73) Assignee: Guangdong Haihong Co., Ltd., Kaiping (CN)

( * ) Notice: Subject to any disclaimer, the term of this patent is extended or adjusted under 35 U.S.C. 154(b) by 0 days.

(21) Appl. No.: 13/696,941

(22) PCT Filed: Oct. 31, 2011

(86) PCT No.: PCT/CN2011/081580

§ 371 (c)(1), (2), (4) Date: Nov. 8, 2012

(87) PCT Pub. No.: WO2012/163035

PCT Pub. Date: Dec. 6, 2012

(65) Prior Publication Data

US 2013/0200967 A1 Aug. 8, 2013

(30) Foreign Application Priority Data

May 27, 2011 (CN) ..... 2011 1 0139988

(51) Int. Cl.

| | |
|---|---|
| ***H01F 27/30*** | (2006.01) |
| ***H01F 30/12*** | (2006.01) |
| ***H01F 27/02*** | (2006.01) |
| ***H01F 27/29*** | (2006.01) |
| ***H01F 27/28*** | (2006.01) |

(52) U.S. Cl.

USPC ..... 336/196; 336/5; 336/96; 336/192; 336/205; 336/206; 336/223

(58) Field of Classification Search

USPC ..... 336/5, 96, 192, 196, 205, 206, 223

See application file for complete search history.

(56) References Cited

U.S. PATENT DOCUMENTS 5,396,210 A * 3/1995 Purohit et al. ..... 336/60
5,461,772 A * 10/1995 Puri ..... 29/605

(Continued)

FOREIGN PATENT DOCUMENTS

CN 2645192 Y 9/2004
CN 201196899 Y 2/2009

(Continued)

OTHER PUBLICATIONS

International Search Report, PCT/CN2011/081580 date of mailing Mar. 8, 2012, 8 pages including English translation.

*Primary Examiner* — Tsz Chan

(74) *Attorney, Agent, or Firm* — Daly, Crowley, Mofford & Durkee, LLP

(57) ABSTRACT

A non-encapsulated-winding stereo wound-core dry-type amorphous alloy transformer. The core of the transformer has a stereo structure. Three lower yokes are placed on a base of a lower clamp, and an upper clamp and the lower clamp are connected with each other by several press screws. Low-voltage windings include a foil-wound or wire-wound cylindrical structure, while its high-voltage windings are wound with oxygen-free copper wires wrapped in an insulate paper and processed through vacuum pressure impregnation. Upper and lower padding blocks support and compress the high-voltage and low-voltage windings, so that the product is formed in a rigid stereo frame structure.

4 Claims, 6 Drawing Sheets

(56) References Cited

U.S. PATENT DOCUMENTS

| | | | | |
|---|---|---|---|---|
| 6,147,580 | A * | 11/2000 | Rettew et al. | 336/60 |
| 7,830,233 | B2 * | 11/2010 | Hrkac | 336/196 |
| 8,284,006 | B2 * | 10/2012 | Bacarisse | 336/90 |

FOREIGN PATENT DOCUMENTS

| | | | |
|---|---|---|---|
| CN | 201402716 | Y | 2/2010 |
| CN | 201478091 | U | 5/2010 |
| CN | 202067642 | U | 12/2011 |

* cited by examiner

NON-ENCAPSULATED-WINDING STEREO WOUND-CORE DRY-TYPE AMORPHOUS ALLOY TRANSFORMER

BACKGROUND

There is a significant advantage in transformer energy saving, environment protection and operation cost for conventional dry-type amorphous alloy transformers. The no-load loss of such transformers is 60%~70% lower than it of the 10-type transformer series, and its operation cost is low and its overall economic efficiency is high. However, because the amorphous alloy sheets are very thin and sensitive to mechanical stress, and have vary sensitive magnetostriction performance and low saturation magnetic flux density, and the structure of the amorphous alloy transformer core pillars and windings is usually in a rectangle shape, two major defects exist with the conventional amorphous alloy dry-type transformers, including high noise level and low short-circuit withstanding ability.

SUMMARY OF THE INVENTION

Exemplary embodiments of the invention provide a non-encapsulated-winding stereo wound-core dry-type amorphous alloy transformer which can reduce working noise and enhance the ability of the transformer to operate with a short-circuit.

In one embodiment, a non-encapsulated-winding stereo wound-core dry-type amorphous alloy transformer, comprises a clamp, core and winding. The winding comprises three phase windings wound on the core pillar. Each phase winding comprises a high-voltage winding and a low-voltage winding. The clamp comprises an upper clamp, a lower clamp, an upper pressing board, a lower pressing board and a plurality of pressing screws. In one embodiment, the features of the transformer include: the core comprises three amorphous alloy single frames annularly arranged, every two adjacent of which are pieced together; the cross section of the vertical and horizontal sides of each single frame edge is in an approximately semi-circular or semi-regular-polygonal shape; the horizontal sides of the single frames form yokes, the vertical sides of every two adjacent frames are pieced together to form a core pillar, the cross section of the core pillars is in an approximately circular or regular-polygonal shape.

The lower pressing board is fixedly connected with the base of the lower clamp through a supporting rods the upper end lower pressing boards cooperate with the pressing screws; the upper pressing board is located on the top of the core, while the lower press board is located on the bottom of the core.

The yokes in the upper portion of the core are arranged between the outer side of upper pressing board and the inner side of the upper clamp, end the yokes in the lower portion of the core are arranged on the base located between the lower pressing board and the lower clamp foundation; the high voltage-windings and low-voltage windings are arranged on the core pillars.

The transformer further comprises upper padding blocks and lower padding blocks, which are arranged at the ends of the high-voltage windings and low-voltage windings, respectively; the lower clamp and the lower pressing board support the lower padding blocks, while the upper darn and the upper pressing board compress the upper padding blocks.

The low-voltage windings are with a foil-wound or wire-wound cylindrical structure, with an insulative paper, such as NOMEX®, is used for layer insulation and end Insulation.

The high-voltage windings have a disk structure, using spacers or comb-shaped strips for supporting the windings, optionally, the high-voltage windings are with a layer structure, using NOMEX® paper for example, for layer insulation.

The three connecting terminals of the high-voltage windings and the four connecting terminals of the low-voltage windings are arranged on an instillation stand of the upper clamp located at the opposite sides of the transformer.

An elastic insulation pad is arranged between the yokes and the base.

Exemplary embodiment of the invention provide a non-encapsulated-winding stereo wound-core dry-type amorphous alloy transformer, combining the advantages of both the stereo wound-core dry-type transformers and amorphous alloy dry-type transformers. The non-encapsulated-winding stereo wound-core dry-type amorphous alloy transformer provided has a stereo core structure, the core of which comprises three frames with a semi-circular cross section, and wound with several types of trapezium straps in sequence, two single frames with an approximately semi-circular cross section are combined into a core pillar with an approximately circular cross section. The amorphous alloy sheets are wound closely and tightly, the magnetic conduction direction of the amorphous alloy is completely in line with the magnetic circuit direction of the core, during operation its vibration is small, and the noise caused by laminated core magnetic circuit incoherence is reduced, as well as the high energy consuming areas and weak areas caused by the assembly and disassembly in the conventional amorphous alloy cores are avoided. In addition, the core with a stereo structure can save more amorphous alloy materials, reduce the weight of the core, and further decrease the no-load loss and no-load current of the transformer. Moreover, the windings of such a dry-type amorphous alloy transformer can be produced into a standard circular shape, so that the circumferential forces can be evenly distributed on the winding conductors, for increasing the ability of the transformers to withstand short circuit.

DETAILED DESCRIPTION OF THE EMBODIMENTS

Detailed descriptions for the embodiments of the invention will be made with reference to the drawings.

Figure 1:
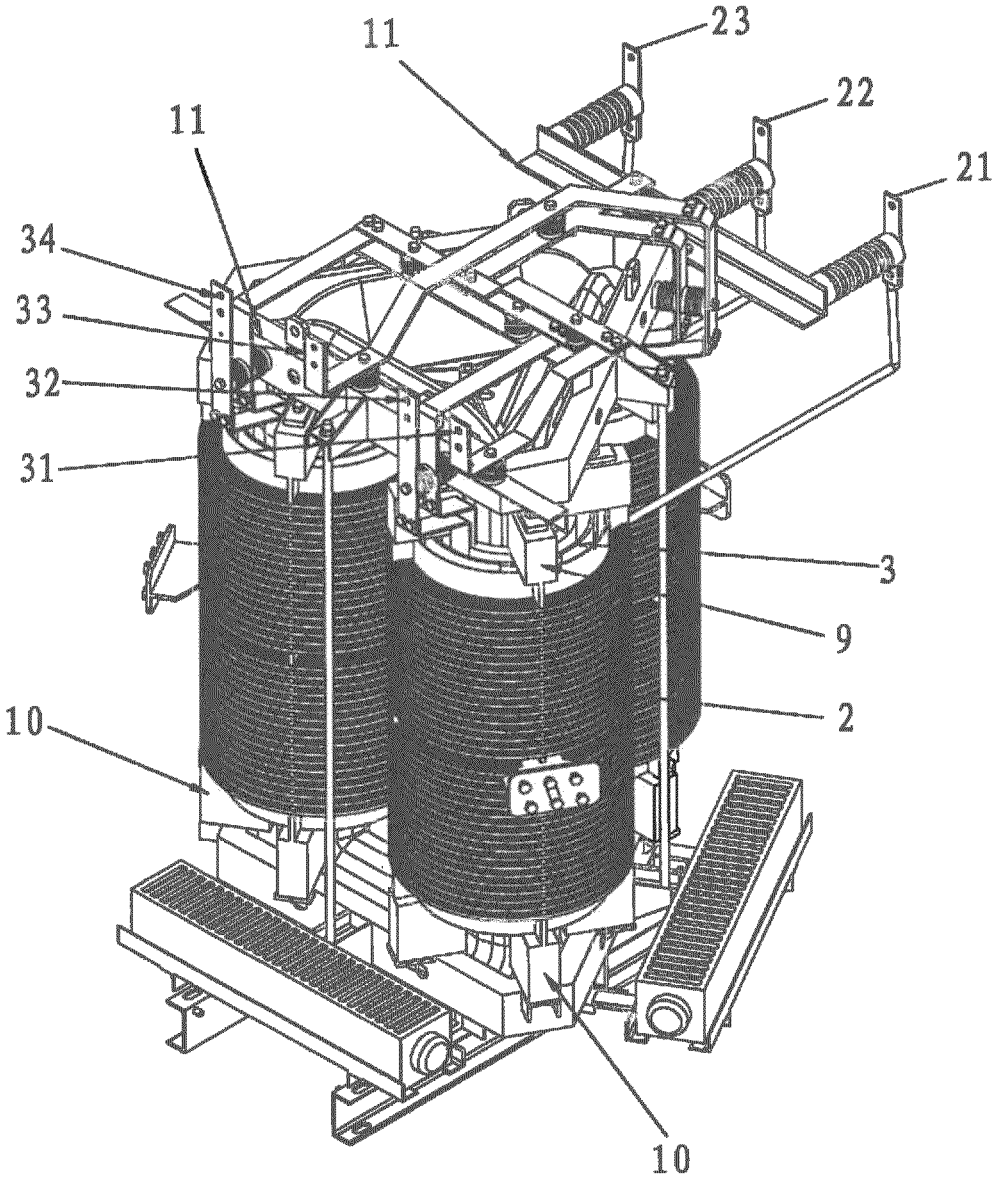
FIG. 1 is a spatial view of the invention.
Figure 2:
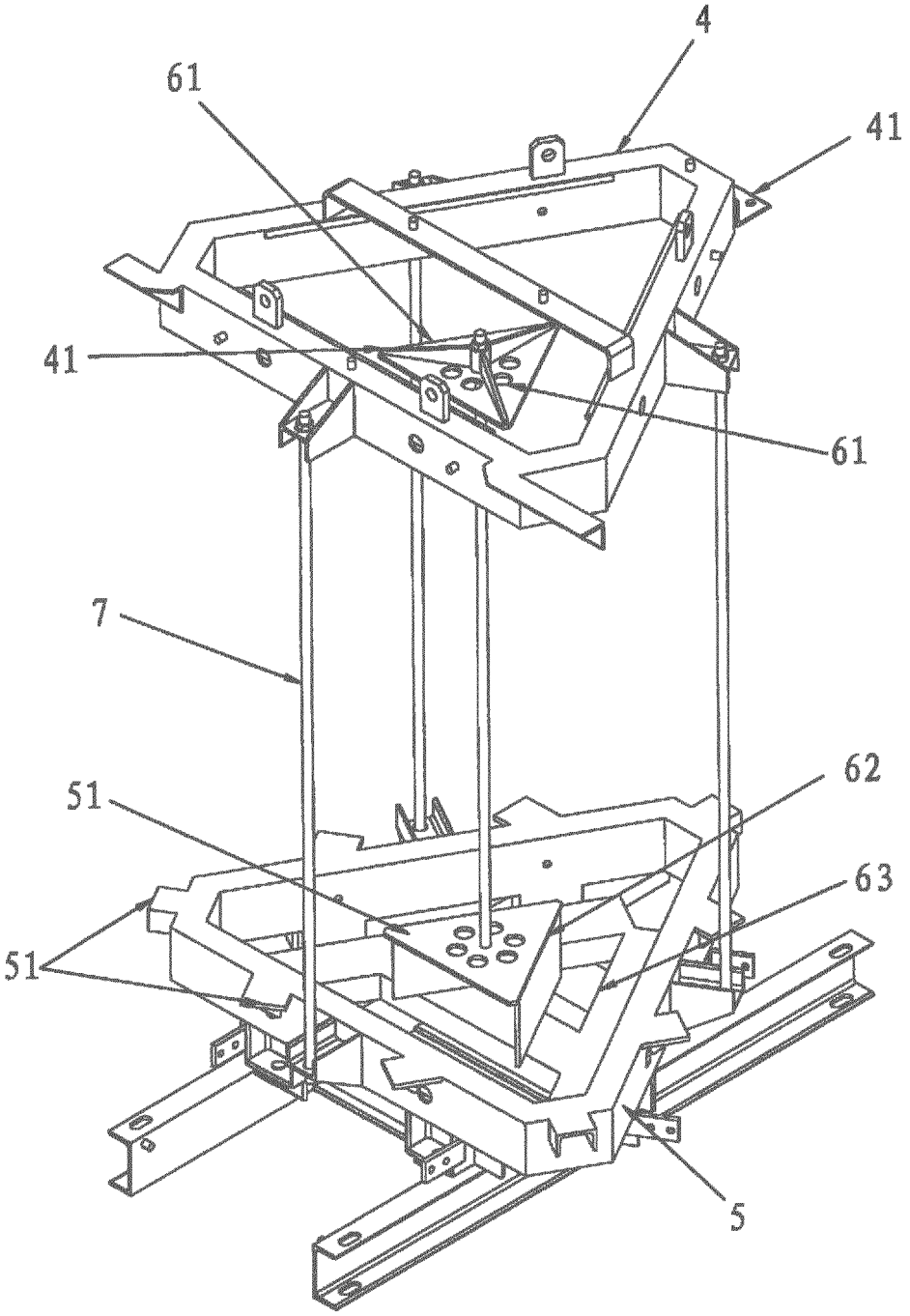
FIG. 2 is a spatial view of a clamp according the invention.
Figure 3:
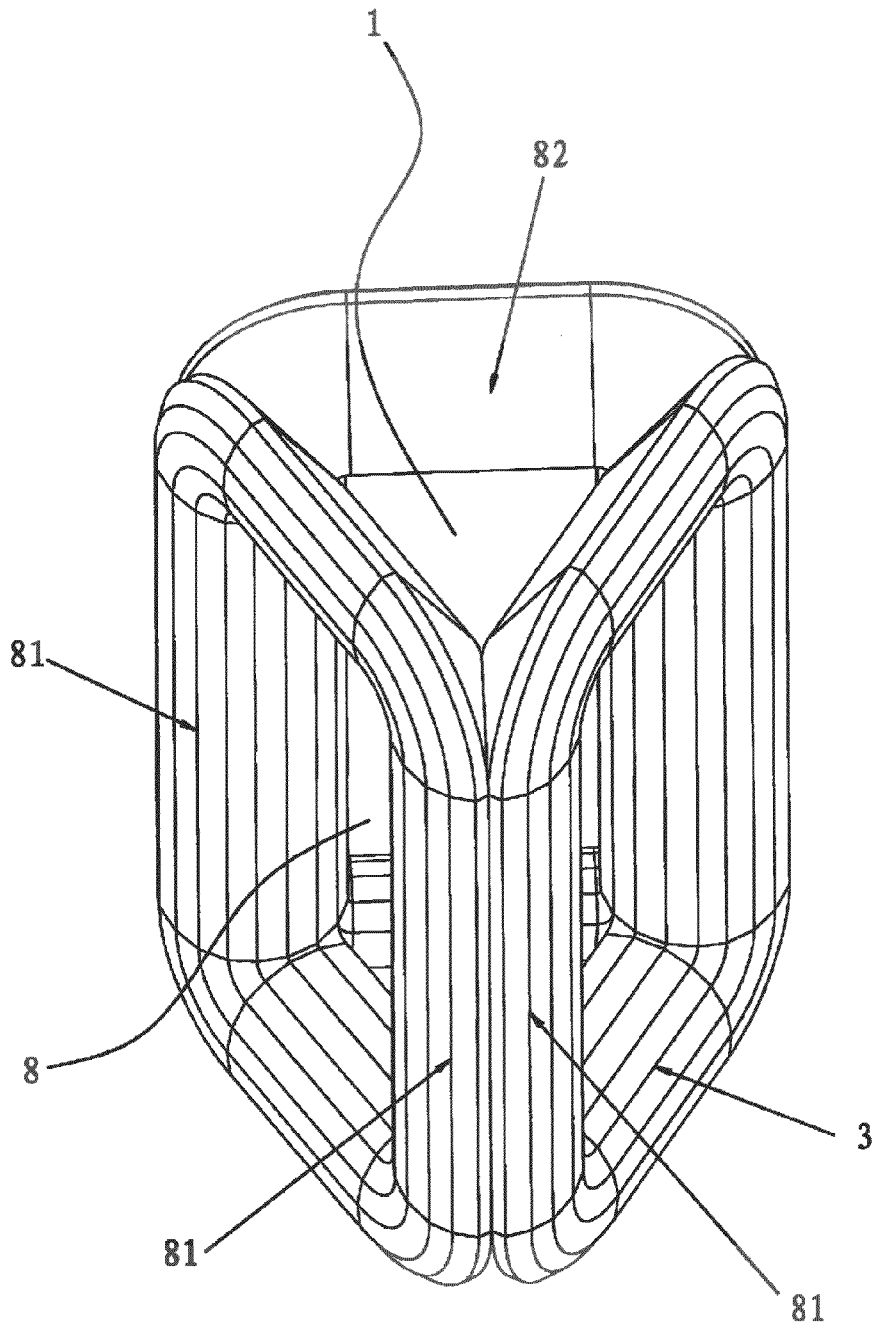
FIG. 3 is a spatial view of a core according the invention.
Figure 4:
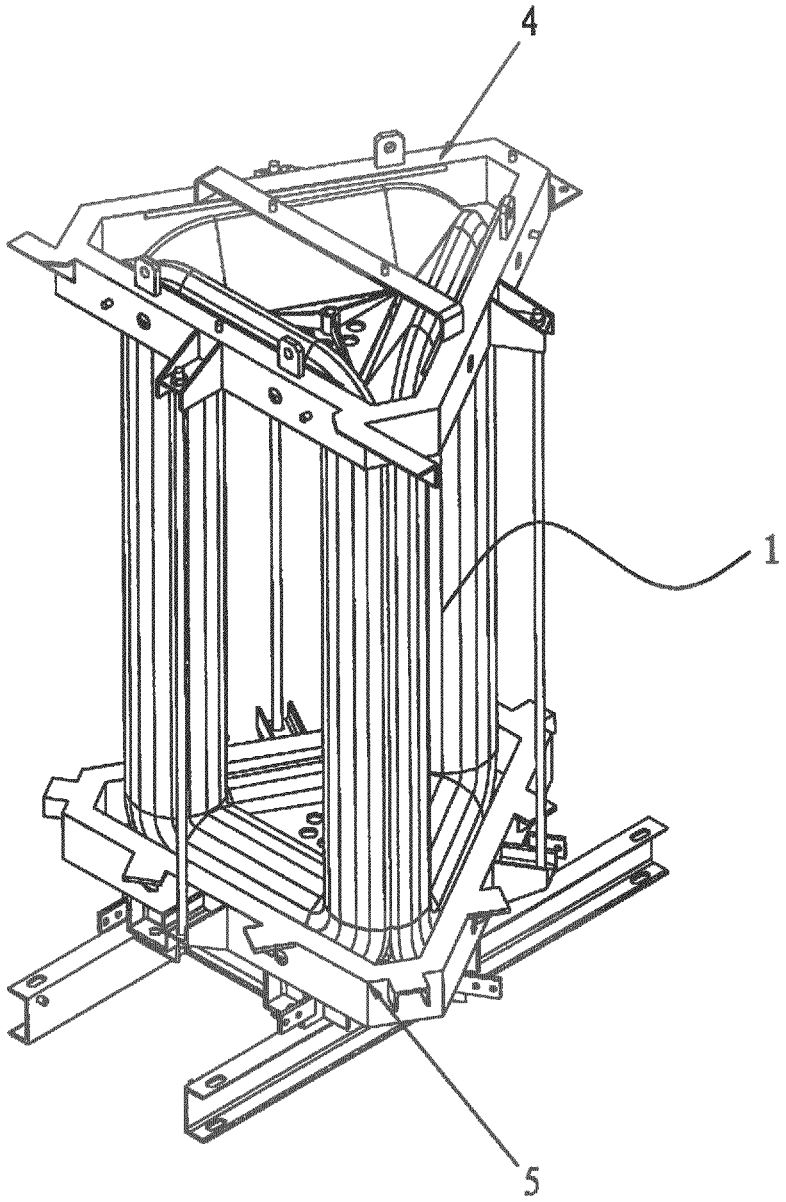
FIG. 4 is an exploded view of the clamp and core.

FIGS. 1, 2 and 3 show a non-encapsulated-winding stereo wound-core dry-type amorphous alloy transformer according to exemplary embodiments of the invention. The transformer comprises a clamp, a core 1 and a winding, wherein the winding comprises three phase windings wound on the core pier of the core 1, each phase winding comprising a high-voltage winding 2 and a low-voltage winding 3.

As shown in FIG. 2, the clamp comprises an upper clamp 4, a lower clamp 5, an upper pressing board 61, a lower pressing board 62 and pressing screws 7.

As shown in FIG. 3, the core 1 comprises three amorphous alloy made single frames 8 arranged annularly, every two adjacent single frames are pieced together, the cross section of the vertical sides 81 and horizontal sides 82 of the single frames is in an approximately semi-circular or semi-regular-polygonal shapes. The horizontal sides 82 form yokes, the vertical sides of every two adjacent single frames 8 are placed together to form a core pillar, the cross section of the core pillars is in an approximately circular or regular-polygonal shape.

As shown in FIG. 2, the lower pressing board 62 is fixedly connected with a base 63 fixed on the lower clamp 5 through a supporting rod, the upper 61 and the lower pressing boards 62 cooperate with the pressing screws 7. The upper pressing board 61 is located on the top of the core 1, while the lower pressing board 62 is arranged on the bottom of the core 1. As shown in FIG. 2. the reference sign 51 indicates the portion for supporting the lower padding blocks 10, while fie reference sign 41 indicates the portion for compressing the upper padding blocks.

The yokes in the upper end of the core 1 are arranged between the outer side of the upper pressing board 61 and the inner side of the upper clamp 4, while the yokes in the lower end of the core 1 are arranged a base 63 provided between the lower pressing board 62 and lower clamp 5. A clamping device is provided between the yokes and the base 63, particularly the clamping device is an elastic insulation pad. With such a structure, the core 1 will not be impacted by the redundant radial forces.

In addition, the high-voltage windings 2 and low-voltage windings 3 are arranged on the core pillars.

Furthermore, upper padding blocks 9 and lower padding blocks 10 are provided, and located at the ends of the high-voltage windings 2 and low-voltage winding 3, respectively; the lower clamp 5 and the lower pressing board 62 support the lower padding blocks 10, while the upper clamp 4 and the upper pressing board 61 compress the upper padding block 9.

Figure 5:
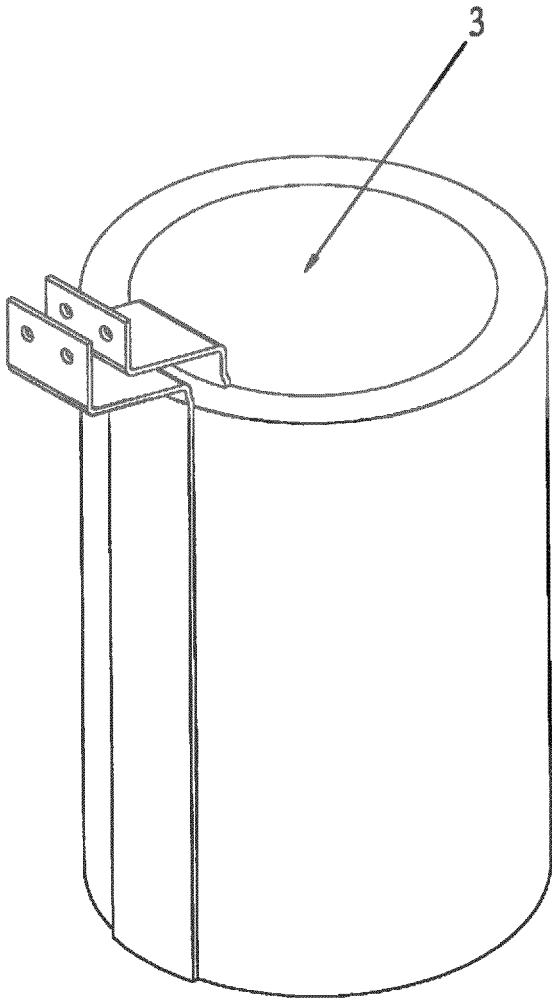
FIG. 5 is a spatial view of a low-voltage foil-wound winding according to the invention.
Figure 6:
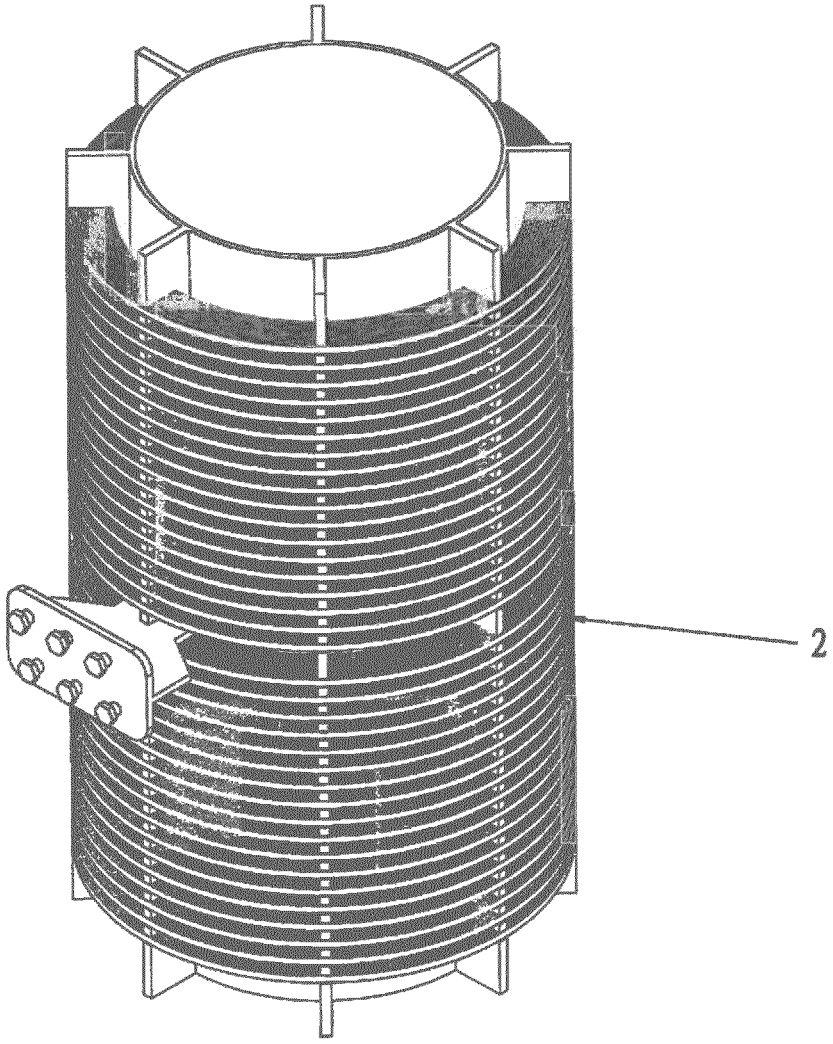
FIG. 6 is a spatial view of a high-voltage winding according to the invention.

As shown in FIG. 5, the low-voltage windings 3 include a foil-wound or wire-wound cylindrical structure, and an insulative paper, such as NOMEX® paper from Dupont Corporation, is used for layer insulation and end insulation.

As shown in FIG. 8, the high-voltage windings 2 have a disk structure using spacers or comb-shaped strips for supporting the windings; optionally, the high-voltage winding can have a layer structure, using NOMEX® paper, for example, for layer insulation.

Three connecting terminals 21, 22, 23 for the high-voltage windings 2 and four connecting terminals 31,32,33,34 for the Sow-voltage windings 3 are respectively arranged on an installation stand 11 of the upper clamp 4 arranged on the opposite sides of the transformer.

While exemplary embodiments of the invention have been described in terms of what are presently considered to be the most practical and preferred embodiments, it is to be understood that the Invention need not be limited to the disclosed embodiments. On the contrary, it is intended to cover various modifications and similar arrangements included within the spirit and scope of the appended claims which are to be accorded with the broadest interpretation so as to encompass all such modifications and similar structure.

The invention claimed is:

1. An apparatus, comprising:

a non-encapsulated-winding stereo wound-core dry-type amorphous alloy transformer, comprising:

a clamp comprising an upper clamp, a lower clamp, an upper pressing board, a lower pressing board and pressing screws; a core comprising core pillars; and a winding comprising three phase windings wound on the core pillars of the core, each phase winding comprising a high-voltage winding and a low-voltage winding;

wherein the core comprises first, second, and third amorphous alloy made of single frames arranged annularly, wherein adjacent single frames are pieced together;

wherein horizontal sides of the single frames form yokes, while the vertical sides of adjacent single frames are pieced together to form the core pillar, the cross section of the core pillars are generally circular;

wherein the lower pressing board is fixedly connected with a base fixed on the lower clamp through a supporting rod, the upper and lower pressing boards are configured to cooperate with the pressing screws; the upper pressing board located on the top of the core, the lower pressing heard located on the bottom of the core;

wherein the yokes on the upper end of the core are arranged between an outer side of the upper pressing board and an inner side the upper clamp, the yokes on the lower end of the core are arranged on the base located between the lower pressing board and the lower clamp; the high-voltage windings and low-voltage windings are arranged on the core pillars;

wherein the transformer further comprises upper padding blocks and lower padding blocks, the lower clamp and the lower pressing board are configured to support the lower padding blocks, while the upper clamp and the upper pressing board are configured to compress the upper padding blocks;

wherein the low-voltage windings are with a foil-wound or wire-wound cylindrical structure, using paper for layer insulation and end insulation;

wherein the high-voltage windings have a disk structure, using spacers or comb-shaped strips for supporting the windings, or a layer structure, using paper for layer insulation; and wherein an elastic insulation pad is provided between the yokes and the base.

2. The apparatus according to claim 1, wherein the transformer further comprises three binding terminals for the high-voltages and four connecting-terminals for the low-voltage windings, which are respectively arranged on an installation stand of the upper clamp arranged at the opposite sides of the transformer.

3. The apparatus according to claim 1, wherein a cross section of the vertical and horizontal sides of the single frames is generally circular.

4. The apparatus according to claim 1, wherein a cross section of the vertical and horizontal sides of the single frames is generally semi-regular-polygonal shape.

* * * * *